US009543739B2

(12) United States Patent
Sakakura

(10) Patent No.: US 9,543,739 B2
(45) Date of Patent: Jan. 10, 2017

(54) SPARK PLUG, AND METHOD FOR MANUFACTURING SPARK PLUG

(71) Applicant: NGK SPARK PLUG CO., LTD., Nagoya (JP)

(72) Inventor: Yasushi Sakakura, Ichinomiya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 69 days.

(21) Appl. No.: 13/869,340

(22) Filed: Apr. 24, 2013

(65) Prior Publication Data

US 2013/0285532 A1 Oct. 31, 2013

(30) Foreign Application Priority Data

Apr. 27, 2012 (JP) ..... 2012-102325

(51) Int. Cl.
*H01T 13/32* (2006.01)
*H01T 13/20* (2006.01)

(52) U.S. Cl.
CPC ..... *H01T 13/20* (2013.01); *H01T 13/32* (2013.01)

(58) Field of Classification Search
CPC ..... H01T 13/20; H01T 13/32
USPC ..... 313/141
See application file for complete search history.

(56) References Cited

U.S. PATENT DOCUMENTS 6,307,307 B1 * 10/2001 Kanao ..... 313/142
7,586,246 B2 9/2009 Okamoto
7,893,604 B2 2/2011 Takeuchi et al.
2005/0174025 A1 8/2005 Okamoto
2008/0092838 A1 4/2008 Takeuchi et al.
2010/0320893 A1 12/2010 Kato

FOREIGN PATENT DOCUMENTS

JP 2003-323962 A 11/2003
JP 2005-251727 A 9/2005
JP 2008-108478 A 5/2008
JP 2011-003478 A 1/2011

OTHER PUBLICATIONS

Office Action mailed Mar. 18, 2014 for the corresponding Japanese Application No. 2012-102325.

* cited by examiner

*Primary Examiner* — Nimeshkumar Patel
*Assistant Examiner* — Christopher Raabe
(74) *Attorney, Agent, or Firm* — Leason Ellis LLP

(57) ABSTRACT

A spark plug comprises an insulator having a axial hole penetrating in a direction of an axis, a central electrode provided on the front end side of the axial hole, a tubular metal shell that holds the insulator, and a ground electrode including a surface layer and a core material that is surrounded by the surface layer and has a larger thermal conductivity than that of the surface layer. The metal shell of the spark plug has a protruding portion in which at least a part of the metal shell protrudes toward the front end side in the direction of the axis. The ground electrode has an end surface at one end portion thereof joined to the inside of the protruding portion and the other end portion thereof facing the central electrode.

9 Claims, 15 Drawing Sheets

SPARK PLUG, AND METHOD FOR MANUFACTURING SPARK PLUG

CROSS REFERENCE TO THE RELATED APPLICATIONS

This application claims the benefit of Japanese Patent Application No. 2012-102325, filed Apr. 27, 2012, which is incorporated entirely by reference herein.

FIELD OF THE INVENTION

The present invention relates to a spark plug.

BACKGROUND OF THE INVENTION

Conventionally, as a technique relating to a spark plug having a noble metal tip at the front end of a ground electrode, for example, the technique disclosed in JP-A-2005-251727 is known. In this technique, the ground electrode is welded to one end surface and the inner circumferential surface of a metal shell in a state in which an end surface in the lateral direction is exposed.

In the technique of the related art, since the end surface of the ground electrode in the lateral direction is in a state of being exposed to the outside, it is difficult to configure an inner layer mainly including copper in the ground electrode. This is because the operation environment of the ground electrode is at a high temperature, and, when the ground electrode is formed in a state in which the inner layer mainly including copper with a low melting point is exposed to the outside, there is a concern that the copper may be melted due to combustion heat, and the ground electrode may be deformed or detached. In addition, in the technique of the related art, even when the inner layer is formed in the ground electrode, since the inner layer moved into a state of being exposed to the outside, it is not possible to sufficiently improve the heat conduction capability of the tip. This is because copper configuring the inner layer is directly joined to the metal shell so that the heat conduction capability of the tip is improved. As described above, in the technique of the related art, there are problems in that the thermal conductivity of the ground electrode is small, and the heat conduction capability of the tip provided in the ground electrode is not sufficient.

SUMMARY OF THE INVENTION

The invention has been made in order to solve at least some of the above problems of the related art, and an object of the invention is to provide a spark plug in which the heat conduction capability of a tip provided in a ground electrode is improved.

The invention can employ the following embodiments or application examples in order to solve at least some of the above problems.

APPLICATION EXAMPLE 1

A spark plug comprises: an insulator having an axial hole penetrating in a direction of an axis, a central electrode provided on the front end side of the axial hole, a tubular metal shell that holds the insulator, and a ground electrode. The ground electrode including a surface layer and a core material that is surrounded by the surface layer and has a larger thermal conductivity than that of the surface layer. The metal shell has a protruding portion in which at least a part of the metal shell protrudes toward the front end side in the direction of the axis. The core material is exposed to the outside on a first end surface present at one end of the ground electrode in the longitudinal direction, and the core material is not exposed to the outside on a second end surface present at the other end of the ground electrode in the longitudinal direction, and the first end surface of the ground electrode is joined to the inside of the protruding portion, and the other end portion of the ground electrode in the longitudinal direction faces the central electrode.

According to the above configuration, since the core material having a larger thermal conductivity than that of the surface layer is contained by the ground electrode, it is possible to increase the thermal conductivity of the ground electrode and to improve the heat conduction capability. Furthermore, since the total length of the ground electrode may be decreased, it is possible to further improve the heat conduction capability of the ground electrode. As a result, it is possible to improve the heat conduction capability of the tip provided in the ground electrode.

APPLICATION EXAMPLE 2

The spark plug according to Application example 1, in which a flat surface is provided at the inside of the protruding portion, and the first end surface of the ground electrode is joined to the flat surface of the protruding portion.

According to the above configuration, since, in the ground electrode, the first end surface to which the core material is exposed may be reliably welded to the metal shell, it is possible to improve the weld strength.

APPLICATION EXAMPLE 3

The spark plug according to Application example 1 or 2, in which the protruding portion has a recess portion at the inside of the protruding portion in a radial direction, and the flat surface is a bottom surface of the recess portion.

According to the above configuration, since the ground electrode is welded to the bottom surface of the recess portion, it is possible to improve the weld strength.

APPLICATION EXAMPLE 4

The spark plug according to Application example 3, in which the depth of the recess portion is 0.2 [mm] or more.

According to the above configuration, since the high grooving of welding droop, which are generated when welding the ground electrode, into the inside of the metal shell may be suppressed, it is possible to suppress the occurrence of a phenomenon in which a leak current is generated between the generated welding droop and the central electrode so as to inhibit the generation of a discharge between the intended electrodes.

APPLICATION EXAMPLE 5

The spark plug according to any one of Application examples 1 to 4, in which the ground electrode is joined to the inside surface of the protruding portion in a direction perpendicular to the axis direction.

According to the above configuration, since the load applied to a welded portion where the ground electrode and the metal shell are joined may be decreased, it is possible to improve the weld strength.

APPLICATION EXAMPLE 6

The spark plug according to any one of Application examples 1 to 5, in which the metal shell has a screw portion that is screwed with a screw hole of an engine head, and the diameter of the screw portion is M18 or more.

According to the above configuration, even in a spark plug of M18 or more in which the total length of the ground electrode is increased, the heat conduction capability of the ground electrode may be further improved, and it is possible to improve the heat conduction capability of the tip provided in the ground electrode.

APPLICATION EXAMPLE 7

A method for manufacturing the spark plug according to any one of Application examples 1 to 6 including (a) a process of joining a noble metal tip to the ground electrode, and after that, (b) a process of joining the first end surface to the inside of the protruding portion of the metal shell.

According to the above configuration, it is possible to manufacture the spark plug according to any one of Application examples 1 to 6.

APPLICATION EXAMPLE 8

The method for manufacturing the spark plug according to Application example 7, in which the process (b) is carried out using a jig that may hold the ground electrode in a manner in which the noble metal tip of the ground electrode does not cover the joined surface.

According to the above configuration, it is possible to more reliably manufacture the spark plug according to any one of Application examples 1 to 6.

APPLICATION EXAMPLE 9

The method for manufacturing the spark plug according to Application example 7 or 8, in which the side surfaces of the ground electrode and the side surfaces of the recess portion are separated so as to have a space of 0.5 mm or more.

According to the above configuration, since welding droop generated when welding the ground electrode may be accommodated to the space, it is possible to improve the welding strength.

Meanwhile, the invention can be realized in a variety of embodiments. For example, the invention can be realized in embodiments of methods, apparatuses and the like for manufacturing a spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Next, embodiments of a spark plug, which is an aspect of the invention, will be described in the following order.

Figure 1:
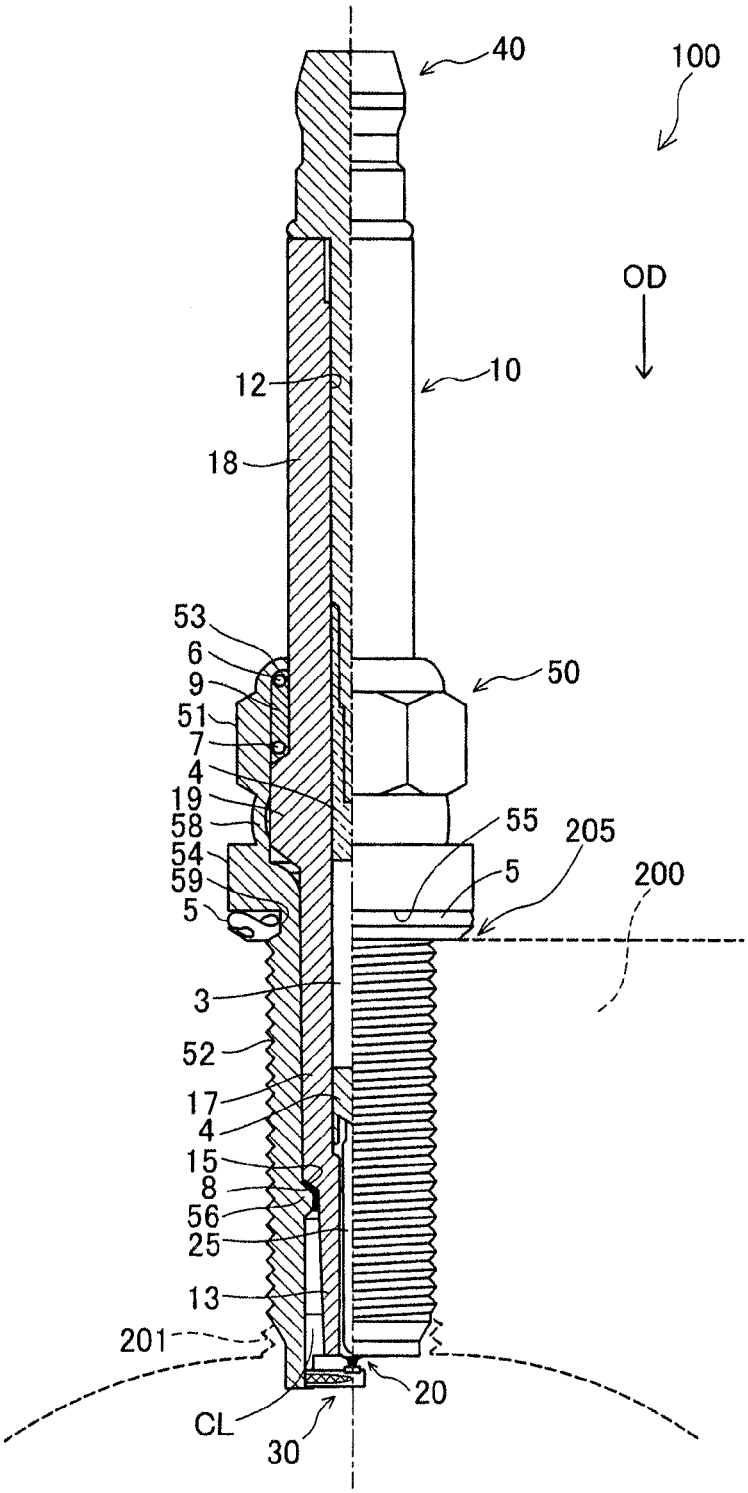
FIG. 1 is a partial cross-sectional view of a spark plug as an embodiment of the invention.

A. First Embodiment:

A-1. Structure of the Spark Plug:

FIG. 1 is a partial cross-sectional view of a spark plug 100 as an embodiment of the invention. In FIG. 1, the direction of the axis OD of the spark plug 100 is considered as the vertical direction in the cross-sectional view, the bottom side is considered as the front end side of the spark plug 100, and the top side is considered as the rear end side.

The spark plug 100 has an insulator 10, a metal shell 50, a central electrode 20, a ground electrode 30, and a terminal clasp 40. The central electrode 20 is held in the insulator 10 in a state of being stretched in the direction of the axis OD. The insulator 10 functions as an insulator, and the metal shell 50 holds the insulator 10. The terminal clasp 40 is provided at the rear end portion of the insulator 10.

The insulator 10 is formed by baking alumina or the like, and has a tubular shape having a axial hole 12 stretched in the direction of the axis OD formed in the shaft center. A guard portion 19 having the largest outer diameter is formed at substantially the center in the direction of the axis OD, and a rear end side trunk portion 18 is formed on the rear end side (the top side in FIG. 1). On the front end side of the guard portion 19 (the bottom side in FIG. 1), a front end side trunk portion 17 having a smaller outer diameter than the rear end side trunk portion 18 is formed, and, furthermore, a long leg portion 13 having a smaller outer diameter than the front end side trunk portion 17 is formed on the front end side of the front end side trunk portion 17. The long leg portion 13 radially contracts toward the front end side, and, when the spark plug 100 is attached to an engine head 200 of an internal combustion engine, the spark plug is exposed to the combustion chamber thereof. A supporting portion 15 is formed between the long leg portion 13 and the front end side trunk portion 17.

The metal shell 50 is a cylindrical clasp formed of a low-carbon steel material, and fixes the spark plug 100 to the engine head 200 of the internal combustion engine. In addition, the metal shell 50 holds the insulator 10 therein, and the insulator 10 has a portion from part of the rear end side trunk portion 18 to the long leg portion 13 surrounded with the metal shell 50.

In addition, the metal shell 50 has a tool engaging portion 51 and an attaching screw portion 52. The attaching screw portion 52 of the metal shell 50 is screwed together with an attaching screw hole 201 of the engine head 200 provided at the top of the internal combustion engine. In the present embodiment, the outer diameter M (nominal diameter) of the attaching screw portion 52 is set to M18. Meanwhile, it is preferable that the outer diameter M of the attaching screw portion 52 be set to M18 or more, but the outer diameter may be M14 or more which is the standard outer diameter. A guard-shaped seal portion 54 is formed between the tool engaging portion 51 and the attaching screw portion 52 of the metal shell 50. A cyclic gasket 5 formed by folding a plate body is tightly inserted into a screw head 59 between the attaching screw portion 52 and the seal portion 54. When the spark plug 100 is attached to the engine head 200, the gasket 5 is pressed and deformed between a bearing surface 55 of the seal portion 54 and an opening circumferential portion 205 of the attaching screw hole 201. The deformation of the gasket 5 seals the space between the spark plug 100 and the engine head 200, and the airtight leakage in the engine through the attaching screw hole 201 is prevented.

A thin swaging portion 53 is provided on the rear end side of the tool engaging portion 51 of the metal shell 50. In addition, a thin buckling portion 58 is provided between the seal portion 54 and the tool engaging portion 51. Toric ring members 6 and 7 are interposed between the inner circumferential surface of the tool engaging portion 51 to the swaging portion 53 of the metal shell 50 and the outer circumferential surface of the rear end side trunk portion 18 of the insulator 10. Furthermore, the space between both ring members 6 and 7 is filled with talc 9 powder. When the swaging portion 53 is folded inward so as to be swaged, the supporting portion 15 of the insulator 10 is supported by a step portion 56 formed at the inner circumference of the metal shell 50 due to a pressing force through the ring members 6 and 7 and the talc 9, and the metal shell 50 and the insulator 10 are integrated. At this time, the air tightness between the metal shell 50 and the insulator 10 is held by a cyclic plate packing 8 interposed between the supporting member 15 and the step portion 56, and the outflow of the combustion gas is prevented. The buckling portion 58 is configured to bend outward in accordance with the addition of a compression force during swaging, and increase the air-tightness in the metal shell 50 through the compressive strokes of the talc 9. Meanwhile, a clearance CL with a predetermined dimension is provided between the front end side of the step portion 56 of the metal shell 50 and the insulator 10.

Figure 2A:
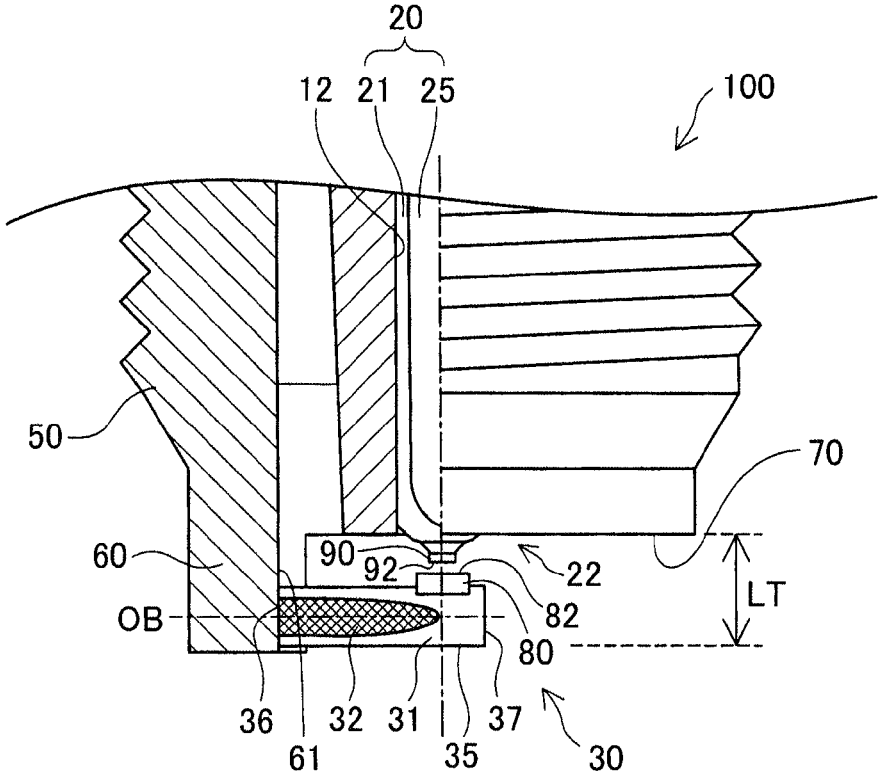
FIGS. 2A and 2B are explanatory views for explaining the configuration of a front end portion of the spark plug.
Figure 2B:
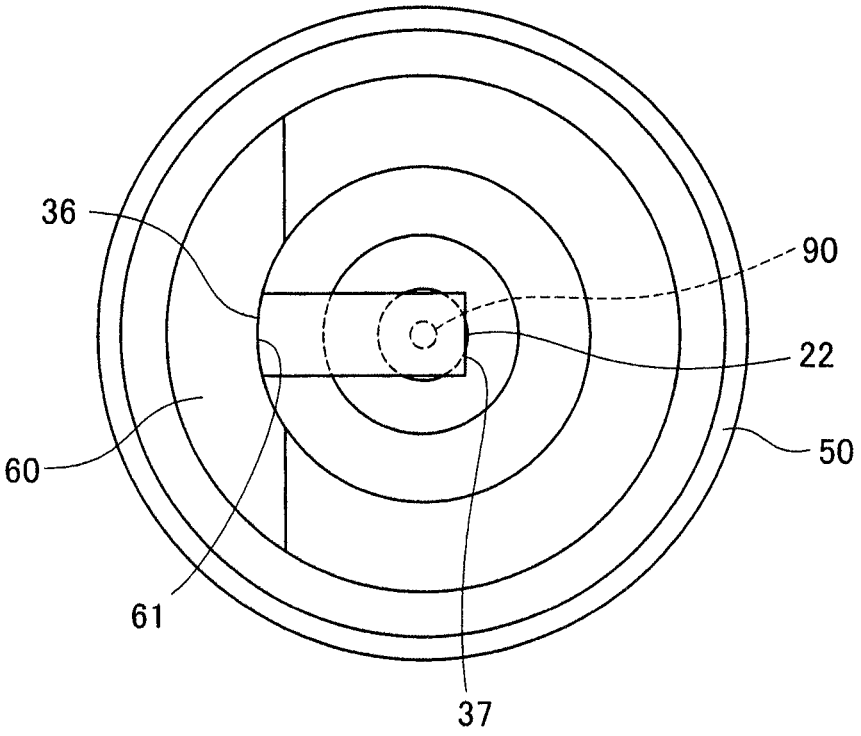

FIGS. 2A and 2B are explanatory views for explaining the configuration of a front end portion of the spark plug 100. FIG. 2A is a partial cross-sectional view of the enlarged vicinity of a front end portion 22 of the central electrode 20. The central electrode 20 is provided on the front end side of the axial hole 12 of the insulator 10.

The central electrode 20 is a rod-shaped electrode having a structure in which a core material 25 is embedded in the inside of an electrode parent material 21. The electrode parent material 21 is formed of nickel, such as INCONEL (registered trade mark) 600 or 601, or an alloy mainly including nickel. The core material 25 is formed of copper or an alloy mainly including copper which has a better thermal conductivity than the electrode parent material 21. In general, the central electrode 20 is manufactured by filling the inside of the electrode parent material 21 formed into a bottomed tubular shape with the core material 25, and extending the electrode parent material from the bottom side by carrying out extrusion. The core material 25 has a substantially constant outer diameter at the trunk portion, but has a radial contraction portion at the front end side. In addition, the central electrode 20 is extended toward the rear end side in the axial hole 12, and is electrically connected to the terminal clasp 40 (FIG. 1) through a seal body 4 and a ceramic resistance 3 (FIG. 1). A high-pressure cable (not shown) is connected to the terminal clasp 40 through a plug cap (not shown) so that a high voltage is applied.

The front end portion 22 of the central electrode 20 protrudes more than the front end portion of the insulator 10. A central electrode tip 90 is joined to the front end of the front end portion 22 of the central electrode 20. The central electrode tip 90 has a substantially cylindrical shape extended in the direction of the axis OD, and is formed of a noble metal with a high melting point in order to improve the spark wear resistance. The central electrode tip 90 is formed of, for example, iridium (Ir) or an Ir alloy obtained by adding one or two or more of platinum (Pt), rhodium (Rh), ruthenium (Ru), palladium (Pd) and rhenium (Re) to the main component of Ir.

A ground electrode 30 has a configuration in which the core material 32 is formed in the inside of a surface layer 31, in other words, a configuration in which the core material 32 is covered with the surface layer 31. The surface layer 31 in the embodiment is formed of, for example, a nickel alloy mainly including nickel, such as INCONEL 600 or 601. In addition, the core material 32 is formed of copper or an alloy mainly including copper. Since the core material 32 has a larger thermal conductivity than that of the surface layer 31, the thermal conductivity of the ground electrode 30 is improved. The core material 32 is contained by the surface layer 31 in a state in which the cross-section of the core material 32 is exposed to the outside on a first end surface 36 present at one end of the ground electrode 30 in the longitudinal direction. On the other hand, the core material 32 is fully contained by the surface layer 31 on the second end surface 37 present at the other end of the ground electrode 30 in the longitudinal direction.

The first end surface 36 of the ground electrode 30 is joined to the inside of a protruding portion 60 of the metal shell 50 in the perpendicular direction OB to the direction of the axis OD. FIG. 2B shows an appearance of the spark plug 100 seen from the front end side. The protruding portion 60 is a portion in which a part of the metal shell 50 is formed so as to protrude toward the front end side in the direction of the axis OD substantially in parallel with the direction of the axis OD. In the embodiment, the protruding portion 60 has a shape in which a part of the cylindrical metal shell 50 protrudes as it is, and an inside surface 61 of the protruding portion 60 curves in a circular-arc shape. Therefore, the ground electrode 30 is joined to the curved inside surface 61.

In the ground electrode 30, the end portion at which the second end surface 37 is present (corresponding to the "other end portion" in the claims) faces the front end portion 22 of the central electrode 20 and a front end surface 92 of the central electrode tip 90. In addition, a ground electrode tip 80 is joined to the end portion on the second end surface 37. A discharge surface 82 of the ground electrode tip 80 faces a front end surface 92 of the central electrode tip 90, and a spark gap is formed between the discharge surface 82 of the ground electrode tip 80 and the front end surface 92 of the central electrode tip 90. Meanwhile, the ground electrode tip 80 can be formed of the same material as that of the central electrode tip 90. Meanwhile, the ground electrode tip 80 corresponds to the "noble metal tip" in the claims.

If the above configuration is employed, since the core material 32 having a larger thermal conductivity than that of the surface layer 31 is contained by the ground electrode 30, it is possible to increase the thermal conductivity of the ground electrode 30 and to improve the heat conduction capability. Furthermore, since the total length of the ground electrode 30, that is, the length of the ground electrode 30 in the longitudinal direction can be decreased compared to a spark plug of the related art, it is possible to further improve the heat conduction capability of the ground electrode 30. As a result, it is possible to improve the heat conduction capability of the tip (ground electrode tip 80) provided in the ground electrode. In addition, the above effect is significant in a large-diameter spark plug in which the total length of the ground electrode 30 is increased, particularly, in a spark plug of M18 or more.

In addition, in the above configuration, since the ground electrode 30 is joined to the inside surface of the protruding portion in a direction OB perpendicular to the axis direction OD, it is possible to decrease a load applied to a welded portion to which the ground electrode 30 and the metal shell 50 are welded. As a result, it is possible to improve the welding strength between the ground electrode 30 and the metal shell 50.

Furthermore, in the above configuration, since the ground electrode 30 is joined to the inside surface of the protruding portion in a direction OB perpendicular to the axis direction OD, it is possible to form the ground electrode 30 in a linear shape. As a result, it is possible to decrease the protrusion length LT of the ground electrode 30. Meanwhile, the protrusion length LT of the ground electrode 30 is defined as the length of the space between the end surface 70 on the front end side of the metal shell 50 and the surface on the opposite side to the surface to which the ground electrode tip 80 is welded (bottom surface 35).

A-2. Method for Manufacturing a Spark Plug:

A spark plug of the related art is manufactured in the following order (a) to (e).

(a) Joining the ground electrode to the metal shell (b) Forming the attaching screw portion and carrying out a plating process (c) Attaching the insulator (d) Joining the ground electrode tip to the ground electrode (e) Curving the ground electrode so as to form the spark gap However, the spark plug 100 of the embodiment cannot be manufactured in the order (a) to (e). This is because, in the spark plug 100 of the embodiment, since the ground electrode 30 does not have a curved shape, and the ground electrode 30 is joined to the inside surface of the protruding portion in the direction OB perpendicular to the axis direction OD, the joining of the ground electrode tip 80 is inhibited by the previously attached insulator 10. Hereinafter, a method for manufacturing the spark plug 100 of the embodiment will be described.

Figure 3:
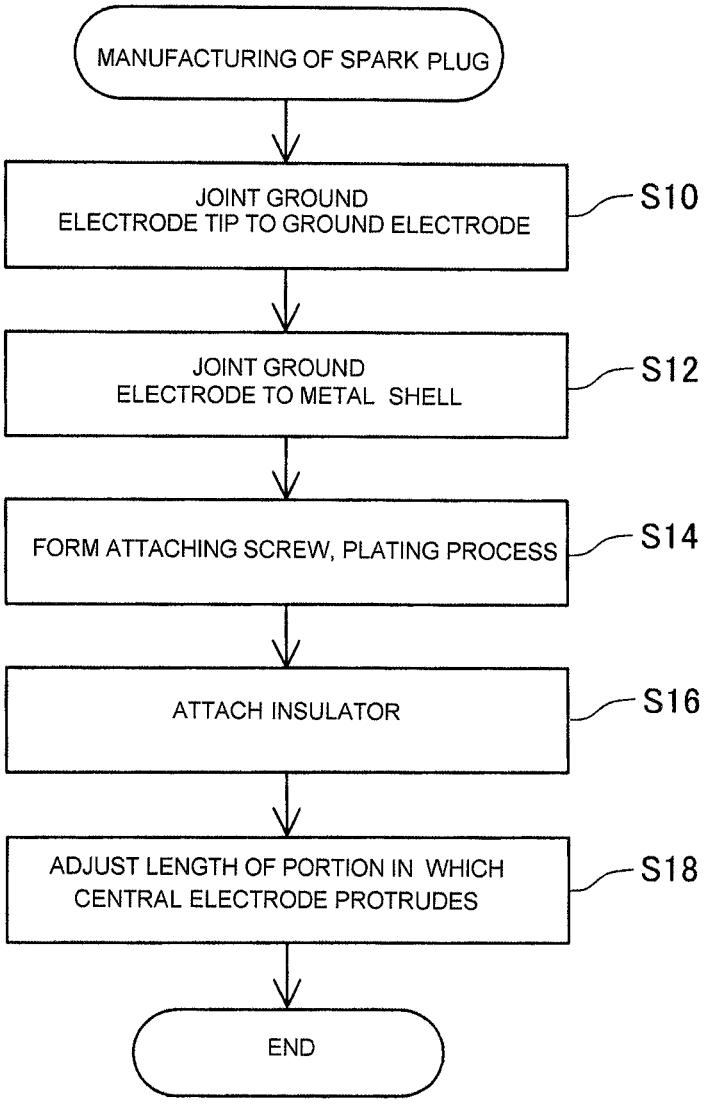
FIG. 3 is a flow chart showing the outline of a method for manufacturing the spark plug in the embodiment.
Figure 4:
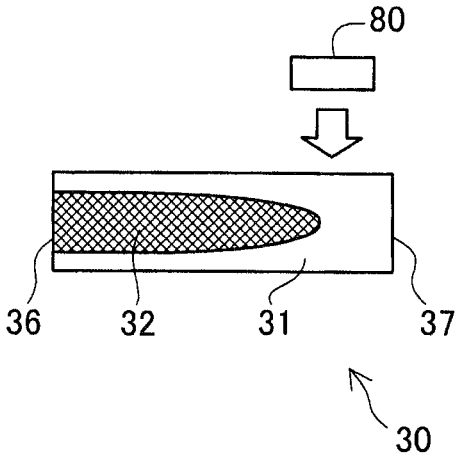
FIG. 4 is an explanatory view showing an appearance in which a ground electrode tip is joined to a ground electrode.

FIG. 3 is a flow chart showing the outline of the method for manufacturing the spark plug 100 in the embodiment. First, the ground electrode tip 80 is joined to the ground electrode 30 (Step S10). FIG. 4 is an explanatory view showing an appearance in which the ground electrode tip 80 is joined to the ground electrode 30. As shown in the drawing, the ground electrode tip 80 is joined to one surface adjacent to the second end surface 37 of the ground electrode 30 using resistance welding or YAG laser welding.

Figure 5A:
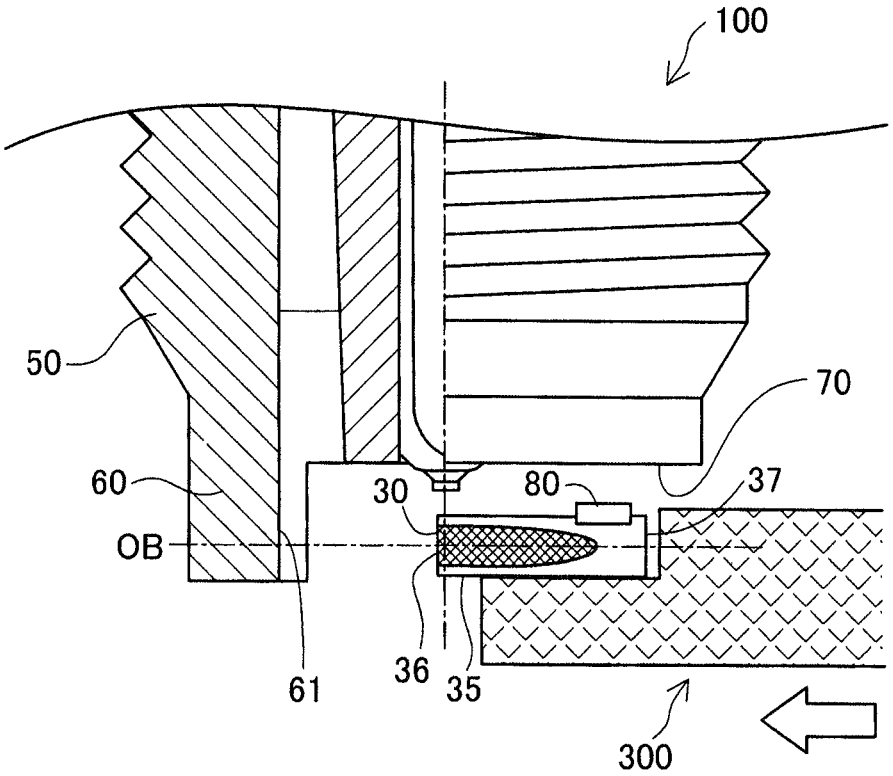
FIGS. 5A and 5B are explanatory views showing an appearance in which the ground electrode is joined to a metal shell.
Figure 5B:
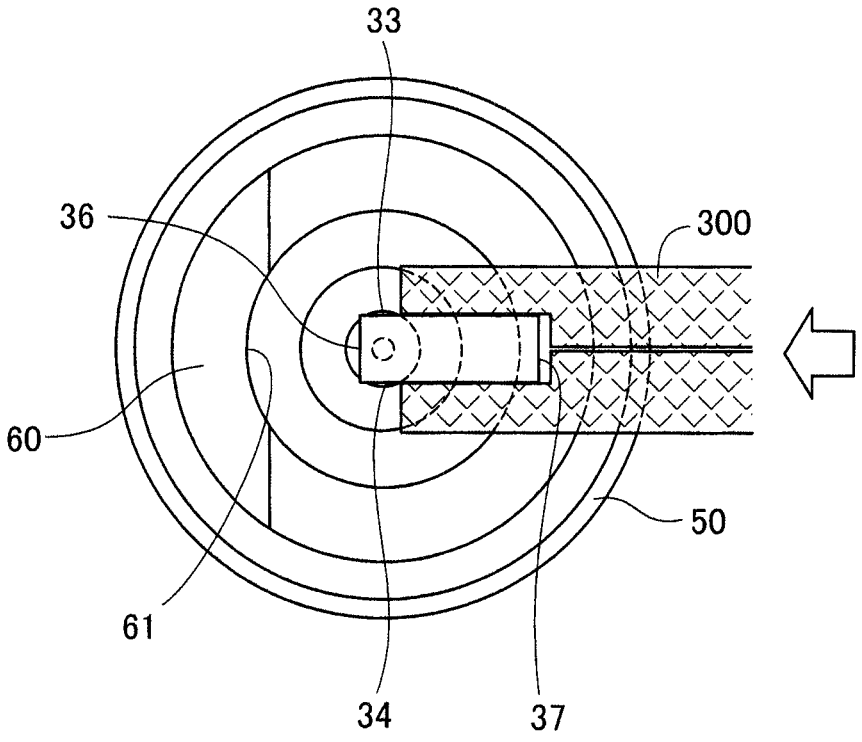

After the joining of the ground electrode tip 80, the ground electrode 30 is joined to the metal shell 50 (Step S12). FIGS. 5A and 53 are explanatory views showing an appearance in which the ground electrode 30 is joined to the metal shell 50. As shown in the drawing, the first end surface 36 of the ground electrode 30, that is, the end surface on the opposite side to the second end surface 37 on a side in which the ground electrode tip 80 is joined is joined to the inside surface 61 of the protruding portion 60. It is possible to use resistance welding or YAG laser welding for the joining.

Meanwhile, in the joining of Step S12, it is preferable that a jig 300, which can hold the ground electrode 30 in a state in which the surface to which the ground electrode tip 80 is joined is not covered, be used. Specifically, in the ground electrode 30, one surface adjacent to both the surface to which the ground electrode tip 80 is joined and the second end surface 37 is considered as a first side surface 33, and the other surface adjacent to both the surface to which the ground electrode tip 80 is joined and the second end surface 37 is considered as a second side surface 34. At this time, the jig 300 holds the ground electrode 30 by pinching the first side surface 33 and the second side surface 34.

When the above jig 300 is used, the ground electrode 30 can be easily joined without the collision of the jig 300 with the central electrode tip 90 or the end surface 70 of the metal shell 50 even in the spark plug 100 in which the interval between the central electrode tip 90 and the ground electrode tip 80 is narrow. As a result, it is possible to more reliably manufacture the spark plug 100.

After the joining of the ground electrode 30, the attaching screw portion 52 is formed in the metal shell 50, and a plating process is carried out on the metal shell 50 (Step S14). Specifically, screw threads are formed at predetermined portions on the surface of the metal shell 50. In addition, in order to suppress the corrosion of the metal shell 50, a coating treatment is carried out on the surface of the metal shell 50 using a nickel plating fluid or the like. After the plating treatment, the insulator 10 is attached (Step S16). The detail is as described in FIG. 1. After the attachment, the width of the central electrode 20 is adjusted (Step S18). Specifically, the length of the portion in which the central electrode 20 protrudes from the metal shell 50 is adjusted by grinding or cutting the central electrode 20.

When the above method is used, since the ground electrode tip 80 is joined to the ground electrode 30 in the beginning, the problems occurring in the method of the related art are solved, and the spark plug 100 of the first embodiment can be manufactured.

B. Second Embodiment:

In a second embodiment of the invention, a configuration in which the shape of the protruding portion of the metal shell is different will be described. Hereinafter, only portions having different configurations from those of the first embodiment will be described. Meanwhile, in the drawing, the same components as in the first embodiment will be given the same reference signs as in the first embodiment described above, and will not be described in detail.

Figure 6A:
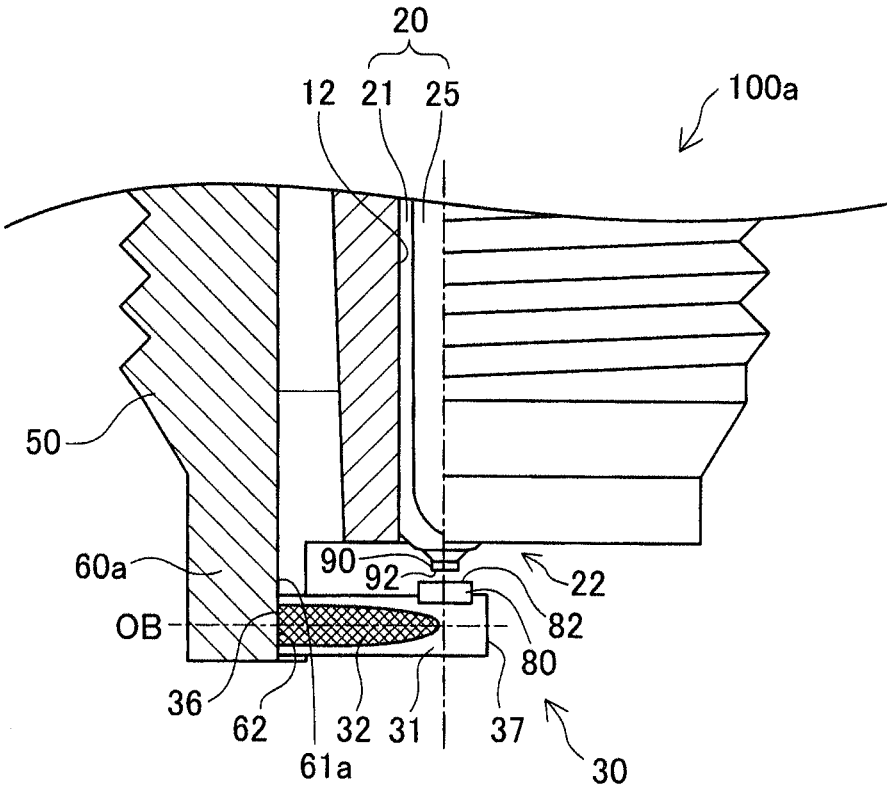
FIGS. 6A and 6B are explanatory views for explaining the configuration of a front end portion of a spark plug of a second embodiment.
Figure 6B:
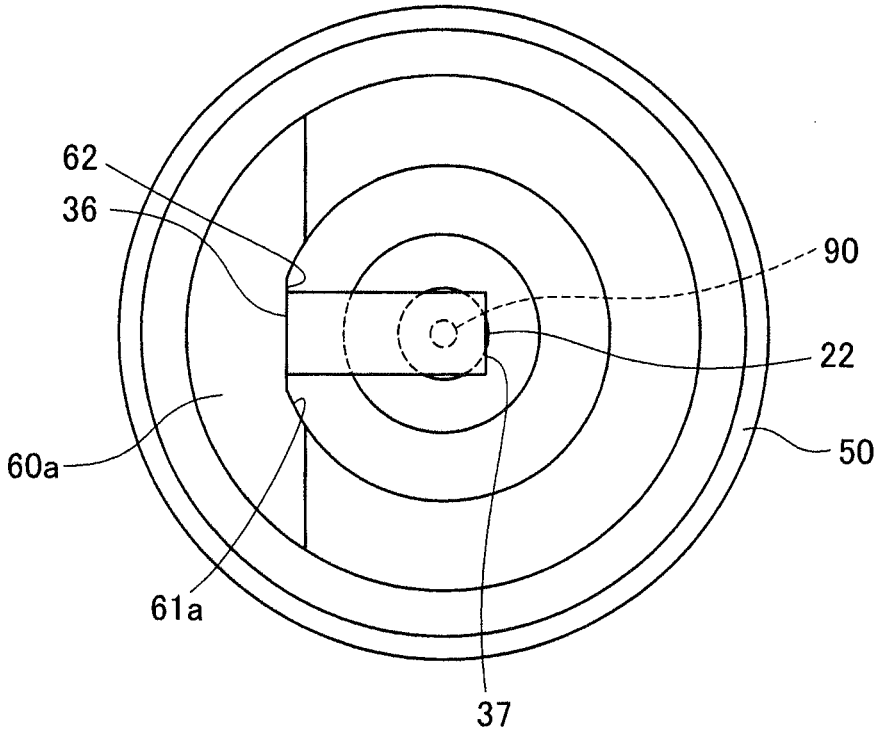

B-1. Structure of the Spark Plug:

FIGS. 6A and 6B are explanatory views for explaining the configuration of the front end portion of a spark plug 100*a* of the second embodiment. FIG. 6A is a partial cross-sectional view of the enlarged vicinity of the front end portion 22 of the central electrode 20. The only difference from the first embodiment shown in FIGS. 2A and 2B is that the metal shell 50 has a protruding portion 60*a* instead of the protruding portion 60.

The protruding portion 60*a* has a shape in which a part of the cylindrical metal shell 50 protrudes, and a flat surface 62, in which an arc-shaped curve is flattened, is formed on the inside surface 61*a* of the protruding portion 60*a*. The flat surface 62 may be formed, for example, through forging or by cutting or grinding the inside surface 61*a*. In the second embodiment, the first end surface 36 of the ground electrode 30 is joined to the flat surface 62 of the metal shell 50.

Even with the above configuration, the same effects as in the first embodiment can be obtained. Furthermore, according to the spark plug 100*a* of the second embodiment, since the first end surface 36 of the ground electrode 30 is joined to the flat surface 62, it is possible to reliably weld the central portion of the core material 32 of the ground electrode 30 to the metal shell 50. As a result, it is possible to improve the welding strength between the ground electrode 30 and the metal shell 50.

B-2. Method for Manufacturing the Spark Plug:

The method for manufacturing the spark plug 100*a* of the second embodiment is the same as the above-described "A-2. method for manufacturing the spark plug".

C. Third Embodiment

In a third embodiment of the invention, a configuration in which the shape of the protruding portion of the metal shell is different will be described. Hereinafter, only portions having different configurations from those of the first embodiment will be described. Meanwhile, in the drawing, the same components as in the first embodiment will be given the same reference signs as in the first embodiment described above, and will not be described in detail.

Figure 7A:
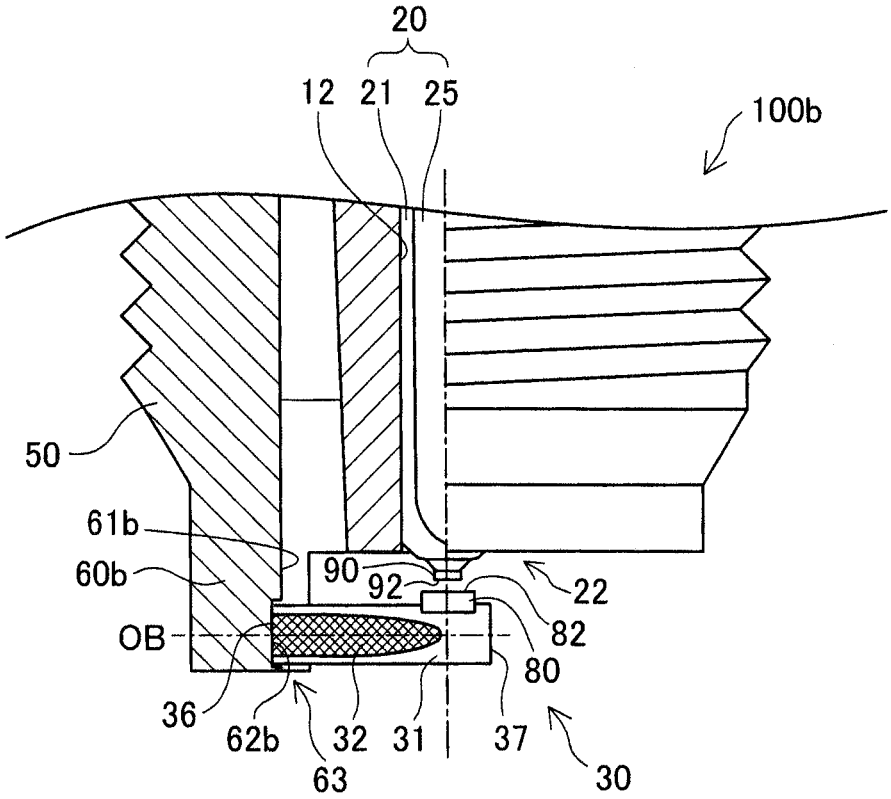
FIGS. 7A and 7B are explanatory views for explaining the configuration of a front end portion of a spark plug of a third embodiment.
Figure 7B:
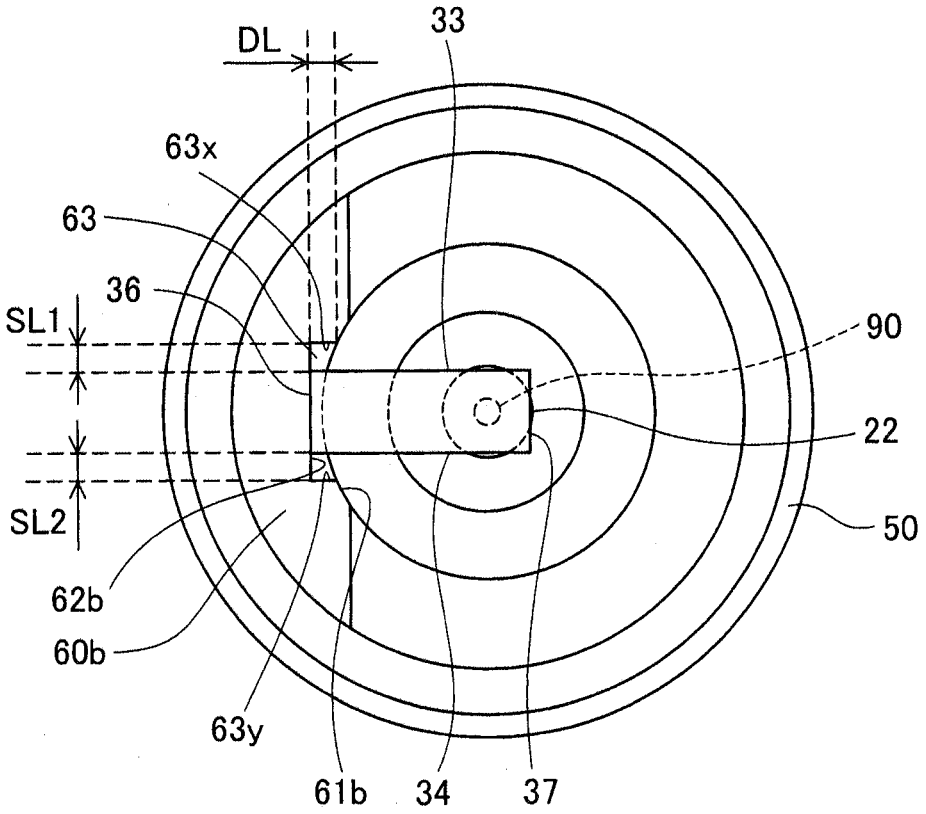

C-1. Structure of the Spark Plug:

FIGS. 7A and 7B are explanatory views for explaining the configuration of the front end portion of a spark plug 100*b* of the third embodiment. FIG. 7A is a partial cross-sectional view of the enlarged vicinity of the front end portion 22 of the central electrode 20. The only difference from the first embodiment shown in FIGS. 2A and 2B is that the metal shell 50 has a protruding portion 60*b* instead of the protruding portion 60.

The protruding portion 60*b* has a shape in which a part of the cylindrical metal shell 50 protrudes, and a recess portion 63, in which a part of an arc-shaped curve is dented, is formed on an inside surface 61*b* of the protruding portion 60*b*. In addition, the flat surface 62*b* is formed on the bottom surface of the recess portion 63. The recess portion 63 and the flat surface 62*b* may be formed, for example, through forging or by cutting or grinding the inside surface 61*b*. In the third embodiment, the first end surface 36 of the ground electrode 30 is joined to the recess portion 63 of the metal shell 50.

Even with the above configuration, the same effects as in the first embodiment can be obtained. Furthermore, according to the spark plug 100*b* of the third embodiment, since the first end surface 36 of the ground electrode 30 is joined to the bottom surface (flat surface 62*b*) of the recess portion 63, it is possible to improve the welding strength between the ground electrode 30 and the metal shell 50.

Meanwhile, in the spark plug 100*b* of the third embodiment, it is preferable that the depth DL of the recess portion 63, in other words, the length DL of the space between the bottom surface (that is, the flat surface 62*b*) of the recess portion 63 and the inside surface 61*b* be 0.2 mm or more. Then, it is possible to suppress the high rise of welding droop, which are generated when welding the ground electrode 30, into the inside surface 61*b* of the metal shell 50, and it is possible to suppress the occurrence of a phenomenon in which a leak current is generated between the generated welding droop and the central electrode 20 so as to inhibit the generation of a discharge between the intended electrodes.

C-2. Method for Manufacturing the Spark Plug:

The method for manufacturing the spark plug 100*b* of the third embodiment is almost the same as the above-described "A-2. method for manufacturing the spark plug". However, when joining the ground electrode 30 to the metal shell 50 (Step S12 in FIG. 3), it is preferable that spaces (gaps) of 0.5 mm or more be provided between the first side surface 33 of the ground electrode 30 and one side surface 63*x* of the recess portion 63, and the second side surface 34 of the ground electrode 30 and the other side surface 63*y* of the recess portion 63. In other words, in FIGS. 7A and 7E, it is preferable that the length SL1 between the first side surface 33 and the side surface 63*x* be 0.5 mm or more. Similarly, it is preferable that the length SL1 between the second side surface 34 and the other side surface 63*y* be 0.5 mm or more.

Then, since welding droop generated when welding the ground electrode 30 to the metal shell 50 can be accommodated to the space, it is possible to improve the welding strength between the ground electrode 30 and the metal shell 50.

D. Experiment Example:

D-1. Experiment Example Relating to the Presence of a Copper Component in the Ground Electrode 30, the Total Length of the Ground Electrode 30 and the Heat Conduction Capability:

In the present experiment example, experiments are carried out in order to investigate the relationship between whether the core material 32 including a copper component is contained by the ground electrode 30, the total length of the ground electrode 30, and the heat conduction capability of the ground electrode tip 80. In the beginning, a plurality of samples #11 to #14 of the spark plug having different conditions is prepared.

Sample #11 is the spark plug 100 of the first embodiment in which the protrusion length LT of the ground electrode 30 is 2.5 mm.

Figure 8:
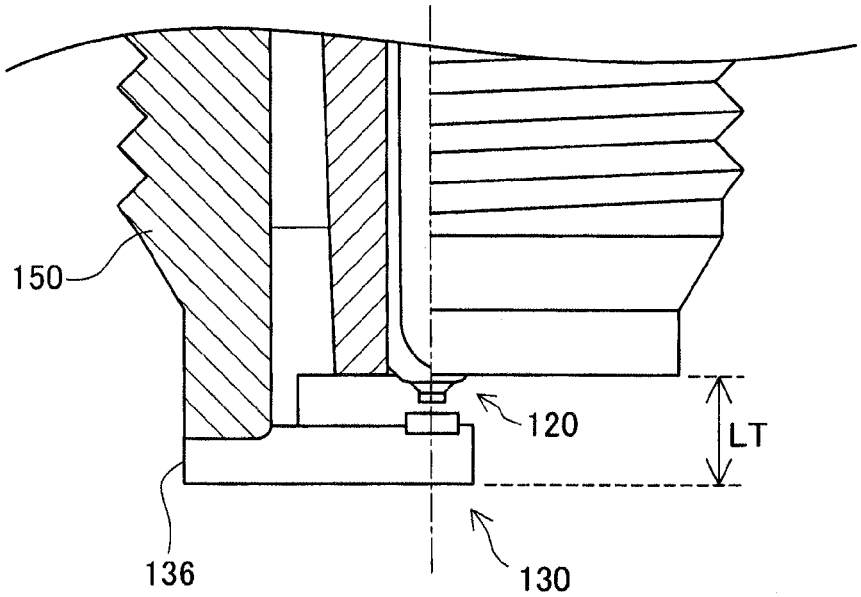
FIG. 8 is an explanatory view for explaining the configuration of a front end portion of a spark plug of Sample #12.

FIG. 8 is an explanatory view for explaining the configuration of the front end portion of the spark plug of Sample #12. In the spark plug of Sample #12, a ground electrode 130 does not have the core material including copper, and a first end surface 136 of the ground electrode 130 is joined to a metal shell 150 in a state of being exposed. The protrusion length LT of the ground electrode 130 in Sample #12 is 2.5 mm.

Figure 9:
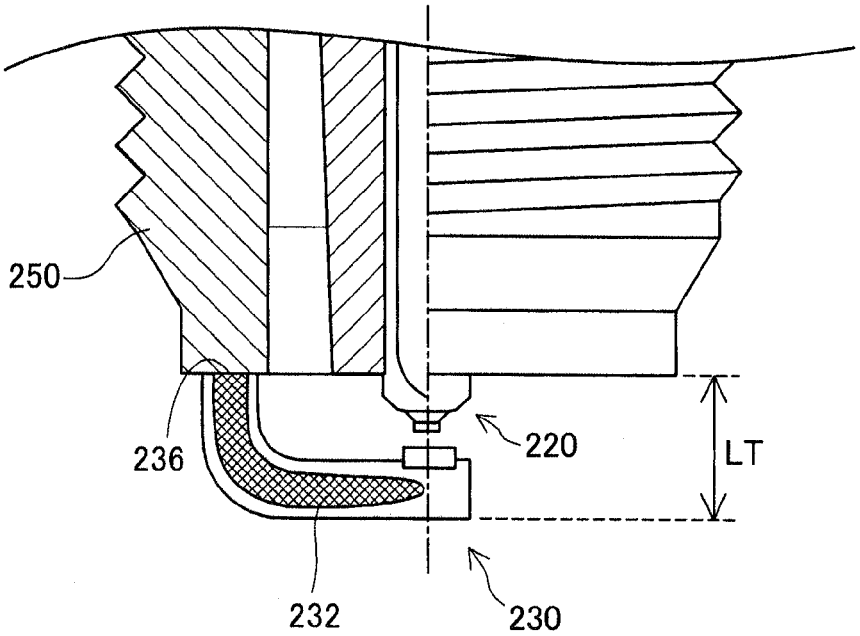
FIG. 9 is an explanatory view for explaining the configuration of a front end portion of a spark plug of Sample #13.

FIG. 9 is an explanatory view for explaining the configuration of a front end portion of a spark plug of Sample #13. In the spark plug of Sample #13, a ground electrode 230 has a core material 232 including copper. In addition, in Sample #13, a first end surface 236 is joined to a metal shell 250, and the ground electrode 230 has a shape curved at substantially 90 degrees. The protrusion length LT of the ground electrode 230 in Sample #13 is 3.5 mm.

Figure 10:
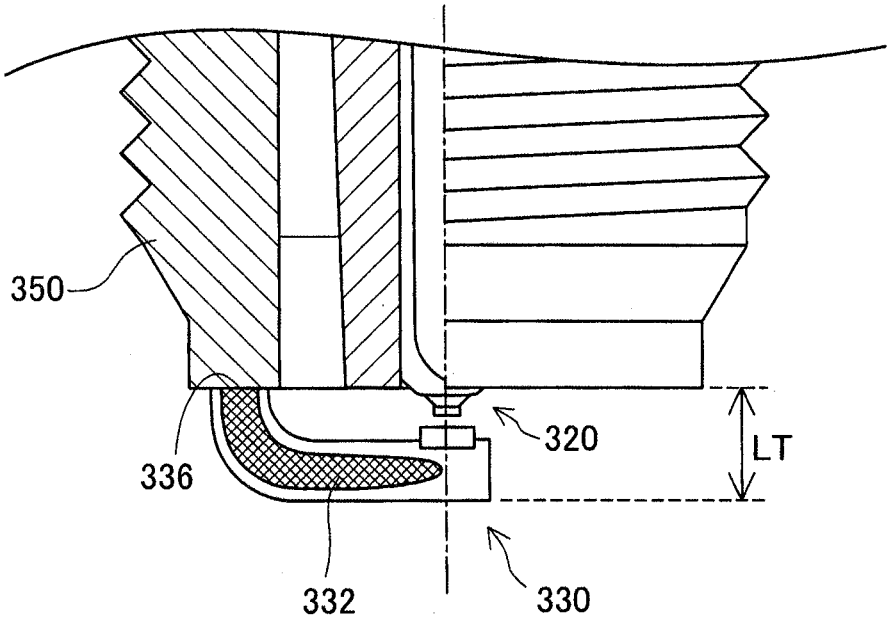
FIG. 10 is an explanatory view for explaining the configuration of a front end portion of a spark plug of Sample #14.

FIG. 10 is an explanatory view for explaining the configuration of a front end portion of a spark plug of Sample #14. In the spark plug of Sample #14, a ground electrode 330 has a core material 332 including copper. In addition, in Sample #14, a first end surface 336 is joined to a metal shell 350, and the ground electrode 330 has a shape curved at substantially 90 degrees. The protrusion length LT of the ground electrode 330 in Sample #14 is 2.5 mm.

In the test, the respective samples are attached to a water cooling bush, are adjusted so that a seat surface 55 of the metal shell 50 became 150° C., and are heated for 30 minutes or more using a heater at 1000° C. at a location 5.0 mm away from the end surface 70 on the front end side of the metal shell 50. After that, the heating is stopped, and the temperature is recorded when the temperature measured using a radiation thermometer became constant. The point of temperature measurement is the portion at which the ground electrode tip 80 of the ground electrode 30 is joined.

Figure 11:
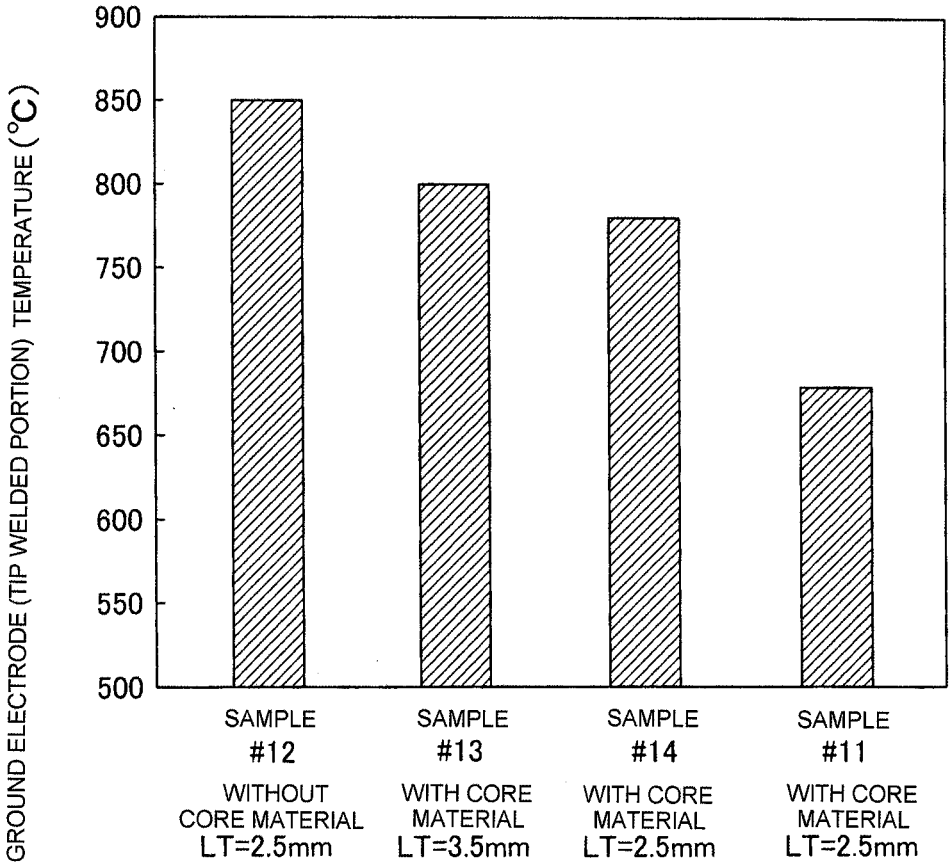
FIG. 11 is a graph showing the experiment results relating to the presence of a copper component in the ground electrode, the total length of the ground electrode and the heat conduction capability.

FIG. 11 is a graph showing the experiment results relating to the presence of a copper component in the ground electrode 30, the total length of the ground electrode 30 and the heat conduction capability. According to FIG. 11, it is found that the temperature decreased from 1000° C. only to approximately 150° C. in Sample #12. In contrast to the above, in Sample #11 of the first embodiment, the temperature decreases from 1000° C. to approximately 320° C. From the above results, it can be understood that the heat conduction capability of the ground electrode tip 80 is improved by including the core material 32 including copper in the ground electrode 30 in the spark plug 100 of the first embodiment.

Furthermore, according to FIG. 11, it is found that, in Samples #13 and #14, the temperature decreased from 1000° C. to approximately 200° C. In contrast to the above, in Sample #11 of the first embodiment, the temperature decreased from 1000° C. to approximately 320° C. From the above results, it can be understood that, in the spark plug 100 of the first embodiment, the heat conduction capability of the ground electrode tip 80 is improved since the total length of the ground electrode 30, that is, the length of the ground electrode 30 in the longitudinal direction is short.

D-2. Experiment Example Relating to the Depth of the Recess Portion 63 and the Height of Welding Droop:

In the present experiment example, experiments are carried out in order to investigate the relationship between the depth of the recess portion 63 of the metal shell 50 and the height of welding droop generated when welding the ground electrode 30 and the metal shell 50. In the beginning, a plurality of samples #21 to #24 of the spark plug having different conditions is prepared.

Sample #21 is the spark plug 100*a* of the second embodiment. Sample #22 is the spark plug 100*b* of the third embodiment in which the depth DL of the recess portion 63 is formed to be 0.7 mm. Sample #23 is the spark plug 100*b* of the third embodiment in which the depth DL of the recess portion 63 is formed to be 0.5 mm. Sample #24 is the spark plug 100*b* of the third embodiment in which the depth DL of the recess portion 63 is formed to be 0.2 mm.

In the present test, the above-described respective samples are manufactured according to the method shown in the "A-2. Method for manufacturing the spark plug", and whether welding droop are generated is checked. In addition, for samples in which welding droop are generated, the height of the welding undercut is measured with respect to the inside surface 61 of the metal shell 50.

Figure 12:
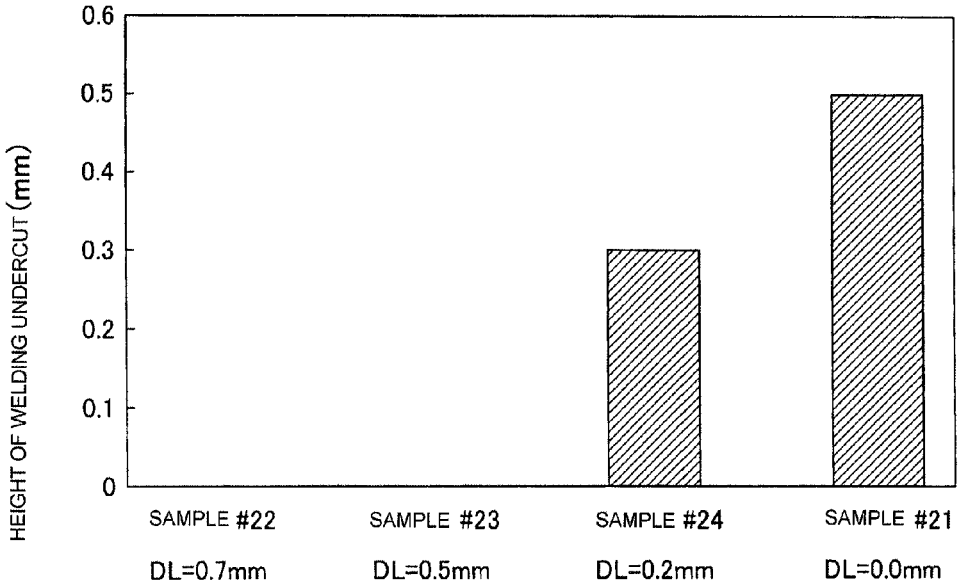
FIG. 12 is a graph showing the experiment results relating to the depth of a recess portion and the height of a welding undercut.

FIG. 12 is a graph showing the experiment results relating to the depth of the recess portion 63 and the height of a welding undercut. According to FIG. 12, it is found that, in Samples #22 and #23 of the third embodiment, welding droop are not generated. In addition, it is found that welding droop with a height of 0.3 mm are generated in Sample #24 of the third embodiment, and welding droop with a height of 0.5 mm are generated in Sample #21 of the second embodiment. From the above results, it can be understood that, in the spark plug 100*b* of the third embodiment, it is possible to suppress the high grooving of welding droop, which are generated when welding the metal shell 50 and the ground electrode 30, into the inside surface of the metal shell 50 by providing the recess portion 63 having a depth. Furthermore, it is found that the depth DL of the recess portion 63 is preferably 0.2 mm or more, and more preferably 0.5 mm or more.

D-3. Experiment Example Relating to the Space Between the Recess Portion 63 and the Ground Electrode 30 and the Welding Strength:

In the present experiment example, experiments are carried out in order to investigate the relationship between the space between the recess portion 63 of the metal shell 50 and the side surface (the first side surface 33 and the second side surface 34) of the ground electrode 30, and the welding strength. In the beginning, a plurality of samples #31 to #34 of the spark plug having different conditions is prepared.

Sample #31 is the spark plug 100 of the first embodiment. Sample #32 is the spark plug 100*b* of the third embodiment in which the space SL between the recess portion 63 and the ground electrode 30 is set to 1.0 mm. Sample #33 is the spark plug 100*b* of the third embodiment in which the space SL between the recess portion 63 and the ground electrode 30 is set to 0.5 mm. Sample #34 is the spark plug 100*b* of the third embodiment in which the space SL between the recess portion 63 and the ground electrode 30 is set to 0.0 mm.

In the present test, in the respective samples, the ground electrode 30 is fixed, and then an external force is applied to the metal shell 50. In addition, a rupture load at which the joined portion between the ground electrode 30 and the metal shell 50 ruptures is measured and used as the welding strength.

Figure 13:
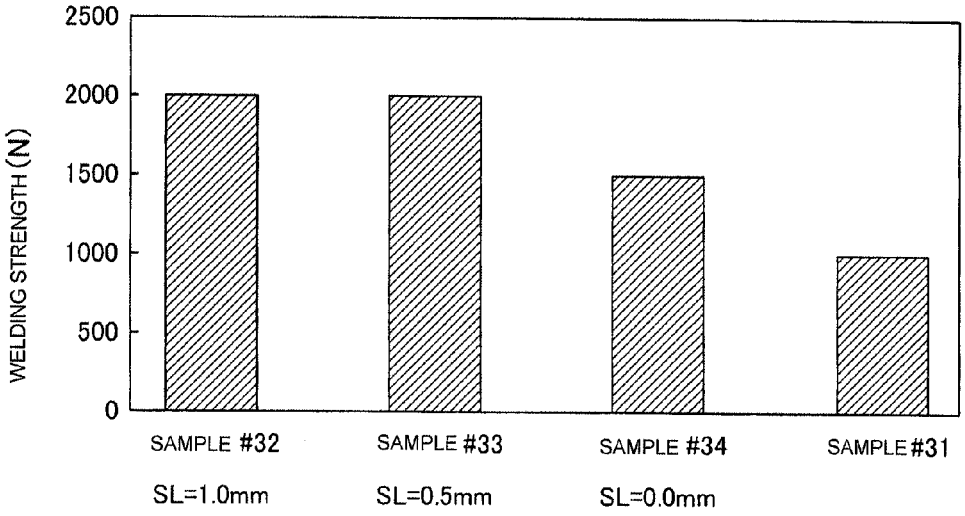
FIG. 13 is a graph showing the experiment results relating to the space between the recess portion 63 and the ground electrode and the welding strength.

FIG. 13 is a graph showing the experiment results relating to the space between the recess portion 63 and the ground electrode 30 and the welding strength.

According to FIG. 13, it is found that, in Samples #32 and #33 of the third embodiment, the welding strength is 2000 N. In addition, it is found that the welding strength is 1500 N in Sample #34 of the third embodiment, and the welding strength is 1000 N in Sample #31 of the first embodiment. From the above results, it can be understood that, in the spark plug 100*b* of the third embodiment, the welding strength between the metal shell 50 and the ground electrode 30 can be improved using the space SL between the recess portion 63 and the ground electrode 30. Furthermore, it is found that it is preferable that the space SL between the recess portion 63 and the ground electrode 30 be 0.5 mm or more.

E. Modification Example:

Meanwhile, the invention is not limited to the above examples or embodiments, can be carried out in a variety of aspects within the scope of the purport of the invention, and, for example, can be modified in the following manner.

MODIFICATION EXAMPLE 1

In the above embodiment, an example of the configuration of the spark plug has been described. However, the embodiment is merely an example, and the configuration of the spark plug can be appropriately set depending on the use of the spark plug, necessary performances, and the like.

For example, in the embodiment, a longitudinal discharge spark plug is exemplified, but the invention may be a transverse discharge spark plug. In addition, the invention can have a configuration in which a plurality of ground electrodes is provided to one central electrode.

MODIFICATION EXAMPLE 2

Figure 14A:
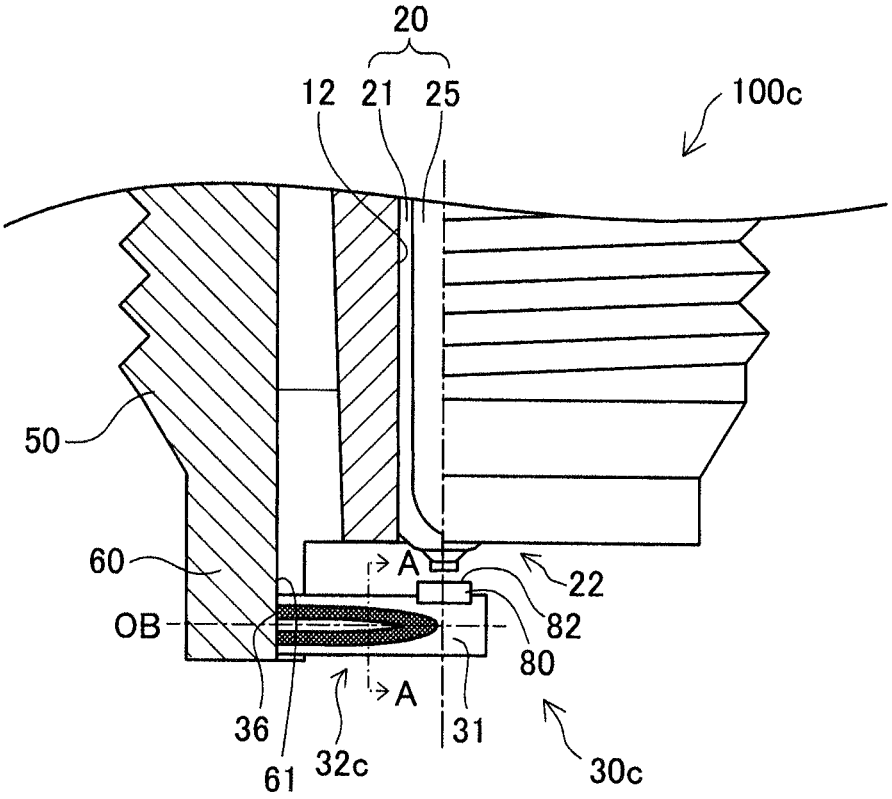
FIGS. 14A and 14B are explanatory views for explaining the configuration of a front end portion of a spark plug in a modification example.
Figure 14B:
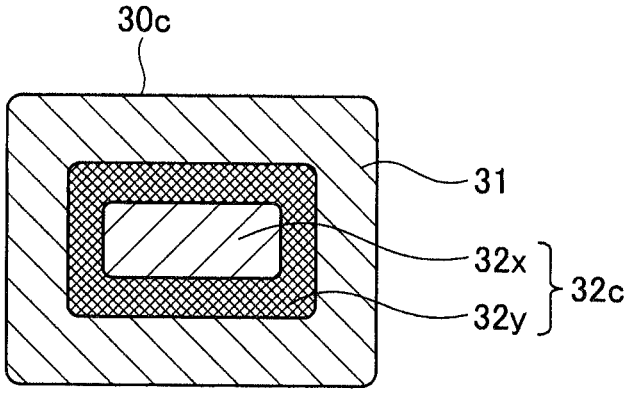

FIGS. 14A and 14B are explanatory views for explaining the configuration of the front end portion of a spark plug 100*c* in the modification example. FIG. 14A is a partial cross-sectional view of the enlarged vicinity of the front end portion 22 of the central electrode 20. The only difference from the first embodiment shown in FIGS. 2A and 2B is that the ground electrode 30*c* is provided instead of the ground electrode 30. The ground electrode 30*c* has a core material 32*c* instead of the core material 32. FIG. 14B shows the cross-sectional configuration of the ground electrode 30*c* at the location A-A in FIG. 14A. As shown in the drawing, the ground electrode 30*c* has a configuration in which the surface layer 31 covers the core material 32*c*. In addition, the core material 32*c* has a configuration in which the second core material 32*y* covers the first core material 32*x*. In the present modification example, the surface layer 31 and the first core material 32*x* are formed of a nickel alloy mainly including nickel. The second core material 32*y* is formed of copper or an alloy mainly including copper. When the above ground electrode 30*c* is used, the thermal conductivity of the ground electrode 30*c* is improved due to the second core material 32*y* so that it is possible to improve the folding workability of the ground electrode 30*c* using the first core material 32*x*.

What is claimed is:

1. A spark plug comprising:

an insulator having a axial hole penetrating in a direction of an axis;

a central electrode provided on a front end side of the axial hole;

a tubular metal shell that holds the insulator; and a ground electrode including a surface layer and a core material that is surrounded by the surface layer and has a larger thermal conductivity than that of the surface layer, wherein the metal shell has a protruding portion in which at least a part of the metal shell protrudes toward a front end side only in the direction of the axis, the core material prior to joining is exposed to an outside on a first end surface present at one end of the ground electrode in a longitudinal direction, the core material is not exposed to the outside on a second end surface present at an other end of the ground electrode in the longitudinal direction, and the first end surface of the ground electrode is joined to an inside surface of the protruding portion such that the first end surface is not exposed to the outside after joining to the inside surface, said inside surface facing the axis, and the other end portion of the ground electrode in the longitudinal direction faces the central electrode.

2. The spark plug according to claim 1, wherein a flat surface is provided at the inside of the protruding portion, and the first end surface of the ground electrode is joined to the flat surface of the protruding portion.

3. The spark plug according to claim 2, wherein the protruding portion has a recess portion at the inside of the protruding portion in a radial direction, and the flat surface is a bottom surface of the recess portion.

4. The spark plug according to claim 3, wherein a depth of the recess portion is 0.2 mm or more.

5. The spark plug according to claim 1, wherein the ground electrode is joined to the inside surface of the protruding portion that is substantially parallel to the axis direction.

6. The spark plug according to claim 1, wherein the metal shell has a screw portion that is adapted to be screwed into a screw hole of an engine head, and a diameter of the screw portion is M18 or more.

7. A method for manufacturing the spark plug according to claim 1, comprising:

(a) a process of joining a noble metal tip to the ground electrode; and after that, (b) a process of joining the first end surface to the inside of the protruding portion of the metal shell.

8. The method according to claim 7, wherein the process (b) is carried out using a jig that can hold the ground electrode in a manner in which the noble metal tip of the ground electrode does not cover the joined surface.

9. A method for manufacturing the spark plug according to claim 3, wherein side surfaces of the ground electrode and side surfaces of the recess portion are separated so as to have a space of 0.5 mm or more.

* * * * *